US006609940B1

(12) United States Patent
Seibold et al.

(10) Patent No.: US 6,609,940 B1
(45) Date of Patent: Aug. 26, 2003

(54) METHOD FOR INSERTING A PUMPING ROD IN A DISCHARGE CHAMBER

(75) Inventors: Michael Seibold, Munich (DE); Michael Ilmer, Augsburg (DE); Angela Eberhardt, Augsburg (DE); Hermann Speer, Sontheim (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 247 days.

(21) Appl. No.: 09/806,762

(22) PCT Filed: Jul. 28, 2000

(86) PCT No.: PCT/DE00/02499

§ 371 (c)(1),
(2), (4) Date: May 17, 2001

(87) PCT Pub. No.: WO01/11651

PCT Pub. Date: Feb. 15, 2001

(30) Foreign Application Priority Data

Aug. 5, 1999 (DE) ..... 199 36 864

(51) Int. Cl.[7] ..... H01J 9/26

(52) U.S. Cl. ..... 445/25; 445/23; 445/24; 445/22; 445/26; 313/234; 313/493; 313/634

(58) Field of Search ..... 445/22, 23, 24, 445/25, 26; 313/493, 634, 25, 490, 234; 315/57, 73, 74, 75

(56) References Cited

U.S. PATENT DOCUMENTS

| | | | | |
|---|---|---|---|---|
| 2,671,291 A | | | 3/1954 | Daley |
| 2,817,927 A | | | 12/1957 | Cowley |
| 4,205,258 A | | * | 5/1980 | Ward |
| 4,414,489 A | | * | 11/1983 | Young |
| 4,512,488 A | | | 4/1985 | Schwenk |
| 5,066,257 A | | | 11/1991 | Farner et al. |
| 5,471,110 A | | * | 11/1995 | Van der Leeuw et al. |
| 5,519,284 A | | | 5/1996 | Pepi |
| 5,719,465 A | | * | 2/1998 | Den Breeijen et al. |
| 5,723,941 A | | * | 3/1998 | Roelevink |
| 5,789,855 A | | * | 8/1998 | Forsdyke et al. |

FOREIGN PATENT DOCUMENTS

| | | |
|---|---|---|
| DE | 22 47 630 B2 | 12/1973 |
| DE | 197 11 892 A1 | 9/1998 |
| FR | 2 607 624 | 6/1988 |
| WO | 98/59357 | 12/1998 |

OTHER PUBLICATIONS

Patent Abstracts of Japan, vol. 1995, No. 05, Jun. 30, 1995, & JP 07 037501 A (Iwasaki Electric Co. Ltd), Feb. 7, 1995.
Patent Abstracts of Japan, vol. 1997, No. 01, Jan. 31, 1997, & JP 08236024A (Iwaki Glass KK), Sep. 13, 1996.
Patent Abstracts of Japan, vol. 1998, No. 12, Nov. 15, 1988, & JP 08287830A (Stanley Electric Co. Ltd.), Nov. 1, 1996.

* cited by examiner

*Primary Examiner*—Anthony Dinkins
*Assistant Examiner*—Nguyen Ha
(74) *Attorney, Agent, or Firm*—Robert F. Clark

(57) ABSTRACT

In a novel method in the field of the production of discharge vessels, in particular for silent flat radiators, an exhaust tube 3 for evacuating and filling is inserted into an opening 2 in the discharge vessel, it being possible in a simple way by means of an adapter 4 to achieve optimum fitting and sealing between a square inner cross section of the opening 2 and a round outer cross section of the exhaust tube 3.

15 Claims, 2 Drawing Sheets

METHOD FOR INSERTING A PUMPING ROD IN A DISCHARGE CHAMBER

TECHNICAL FIELD

The present invention relates to a method for producing flat discharge vessels with two housing plates connected by a flat frame.

BACKGROUND OF THE INVENTION

In discharge vessels for discharge lamps, it is conventional for the exhaust tube to be inserted into an opening in the lamp housing, the remaining interspace needing to be filled with glass solder as sealing material. For this purpose, the latter is brushed on in the form of a paste, if necessary several times, and dried.

This mode of procedure has various disadvantages. Firstly, it is very time intensive. Secondly, it is poorly suited to automated mass production. Thirdly, during drying of the brushed-on layers dry cracks are produced which need to be improved by renewed overbrushing and renewed drying. Nevertheless, it is not always possible to exclude leaks. Moreover, the two abovementioned disadvantages are further worsened by the necessity to repeat the method sequence.

SUMMARY OF THE INVENTION

The invention is therefore based on the technical problem of specifying an improved method for producing a discharge vessel with regard to the insertion of an exhaust tube.

According to the invention, provision is made for this purpose of a method for producing a flat discharge vessel having a frame connecting two housing plates, in which an exhaust tube with a round outer cross section is tightly inserted into an opening in the frame with a square inner cross section, there being inserted between the exhaust tube and the inner wall of the opening a hard adapter which has a continuous opening adapted to the round outer cross section of the exhaust tube and a square outer cross section adapted to the square inner cross section.

In principle, the exhaust tube is to make a good seal with the inner wall of the opening, in order to permit a tight connection. With regard to this, it would be necessary per se to aim at selecting the outer cross section of the exhaust tube and the inner cross section of the opening to be as similar as possible, that is to say not to permit any fundamental deviations in shape, such that there is a need to compensate only slight dimensional deviations. Specifically, when the interspaces which are to be compensated by a sealing material, for example glass solder, which is applied in a liquid state, become too large, problems arise with tightness. This is doubtless to be ascribed to cracks in the sealing material.

However, the invention proceeds from the fact that it is simpler overall, and that the most reliable connections between the exhaust tube and discharge vessel can be produced if use is made of an additional part which is not even necessary in conventional terms. This is the adapter according to the invention, which owing to its physical configuration produces a matching of the shape between the outer cross section of the exhaust tube and the inner cross section of the opening. Specifically, this permits a free selection of the shape of the exhaust tube and of the shape of the opening in the lamp housing of the flat radiator.

The simplifications and advantages in reliability of the process of production thereby achieved overcompensates the additional outlay on producing the adapter. On the one hand, it is possible to use exhaust tubes with a round outer cross section which, for example as simple glass tubes, not only are easy to produce and handle, but also exhibit the smallest difficulties with regard to thermal stresses during the production process. On the other hand, a square opening in the discharge vessel can be used. In many cases, such a square opening is very much simpler to provide than a round opening. In particular, a square opening can be provided effectively in the frame of a flat discharge vessel, for example by simply completely recessing or cutting out a part of the frame such that the opening is delimited on two sides by the plates of the lamp housing of the flat radiator.

The hard adapter can be produced as a semi-finished product without a high outlay on cost, and simplifies the method by virtue of the fact that the fit between the adapter and exhaust tube, or between the inner wall of the opening and adapter is either already so far improved that a thin glass solder layer suffices for tight connection, or results from matching of the shape of the adapter during insertion. For this purpose, the adapter must be softened at least somewhat, in order to assume by contact pressure the required shape for fitting into the opening and/or onto the exhaust tube.

In many cases, the relevant part of the discharge vessel and of the exhaust tube consists of glass. It is then appropriate to select a glass material for the adapter as well. Here, the term glass material also includes so-called glass ceramics. In any case, a material which can be thermally softened is to be selected for matching the shape during insertion.

As already mentioned, softening is required if the adapter is to be optimally matched during insertion by matching the shape. In this case, it is preferable to select for the adapter a material whose softening temperature (which means the melting temperature in the case of punctiform solid/liquid transitions) is lower than the corresponding temperature of the material of the exhaust tube and of the relevant part of the discharge vessel, that is to say the inner wall. It is then possible to achieve softening of the adapter by heating without the occurrence of substantial softening of the exhaust tube or the inner wall. These can then be assembled as fixed components via the space-matching adapter. It is preferred in this case, but not necessary, that the softening of the adapter ensures a tight connection between the surfaces abutting one another upon final assembly. This holds, in particular, for glass materials.

It has proved to be sensible already to mount the adapter on the exhaust tube before insertion into the opening and to connect it tightly to the exhaust tube so that upon final insertion of the exhaust tube and adapter into the opening it is now necessary to undertake a tight connection (and shape matching, if appropriate) with the opening of the discharge vessel. This further simplifies the work sequence, and in particular the exhaust tubes provided with adapters can be prefabricated in relatively large numbers in a separate work step.

A preferred application of the method according to the invention is discharge lamps, in particular ones which are designed for dielectrically impeded discharges, and therefore have at least one electrode which is separated from the discharge volume by a dielectric layer. Such discharge lamps are also denoted as silent discharge lamps. Reference may be made, for example, to the prior German patent application 197 11 890.9 from the same applicant, the disclosure content of which regarding the lamp technology of silent flat radiators is also included here by reference.

As already indicated, the opening in the frame can be produced, for example, by virtue of the fact that a glass strand is not of sufficient length for the circumference of the shape to be formed by the frame, that is to say its dimension is too short according to the width of the opening. However, it is also possible subsequently to cut an opening into an originally essentially closed frame, preferably by water-jet cutting or also by sawing. In the simplest case, substantially flat cut surfaces are produced in the process, and so together with the delimitations by the plates of the discharge vessel a rectangular inner cross section of the opening is produced. It has already been stated that owing to the matching of the favorably round outer cross section of an exhaust tube to this shape, the invention overcompensates the outlay on the easily producible square adapter, inter alia with regard to the achievable high reliability of the connection between the exhaust tube and discharge vessel.

The required adapter can be produced cost effectively and simply in different ways. Injection molding, pressing or extruding, in particular of glass materials (glass or glass solder) come into consideration. It is also possible in this case to produce strand shapes which must then further be cut to length. This holds, in particular, for extrusion. Binder-free glass solder/glass powder can also be used in the case of pressing.

It is preferable to use for the adapter a glass solder which is mixed with a thermoplastic binder material. The thermoplastic binder material serves to shape the glass solder at relatively low temperatures, and can be baked by means of a later step with higher temperatures. This means that the mixture of glass solder and binder can be softened during the production of an extrusion strand or a finished adapter, into a state which is, rather, viscous, and then, for the purpose of producing a seal between the exhaust tube and discharge vessel opening in the true sense, the glass solder itself can be fused, that is to say comes to resemble a liquid.

It is also possible firstly to sinter the adapter onto the exhaust tube, and then to fuse the adapter in the discharge vessel opening. In this case, the adapter with the exhaust tube must be inserted only loosely into the opening. It is preferable in this case for the glass solder to be designed such that the adapter is produced by using the thermoplastic properties of the binder for example by extrusion and cutting to length, for example at 130° C.–180° C., the adapter is then plugged onto the exhaust tube and has the binder removed and is sintered on by a temperature step at, for example, 430–490° C., and the adapter is finally fused in the opening at the assembly temperature when the overall discharge vessel is being assembled.

It is also possible to use a laser for the various temperature steps, for example for local heating of the adapter inserted into the opening. This avoids heating large volumes of the discharge vessel, something which can be advantageous for various reasons. Reference may be made in this regard to the parallel application entitled "Herstellungsverfahren für eine Gasentladungslampe" ["Method for producing a gas discharge lamp"] from the same applicant with the same date of application, the disclosure content of which with regard to the technical details of local heating by laser radiation is also included here. This also relates, in particular, to the use of infrared-absorbing additives.

Of course, it is also possible to use other light sources or heat sources, for example infrared radiators, furnaces or flames.

The invention is discussed below with the aid of an exemplary embodiment, it being possible for features disclosed in this case to be essential to the invention in other combinations as well.

DETAILED DESCRIPTION OF THE INVENTION

Figure 1:
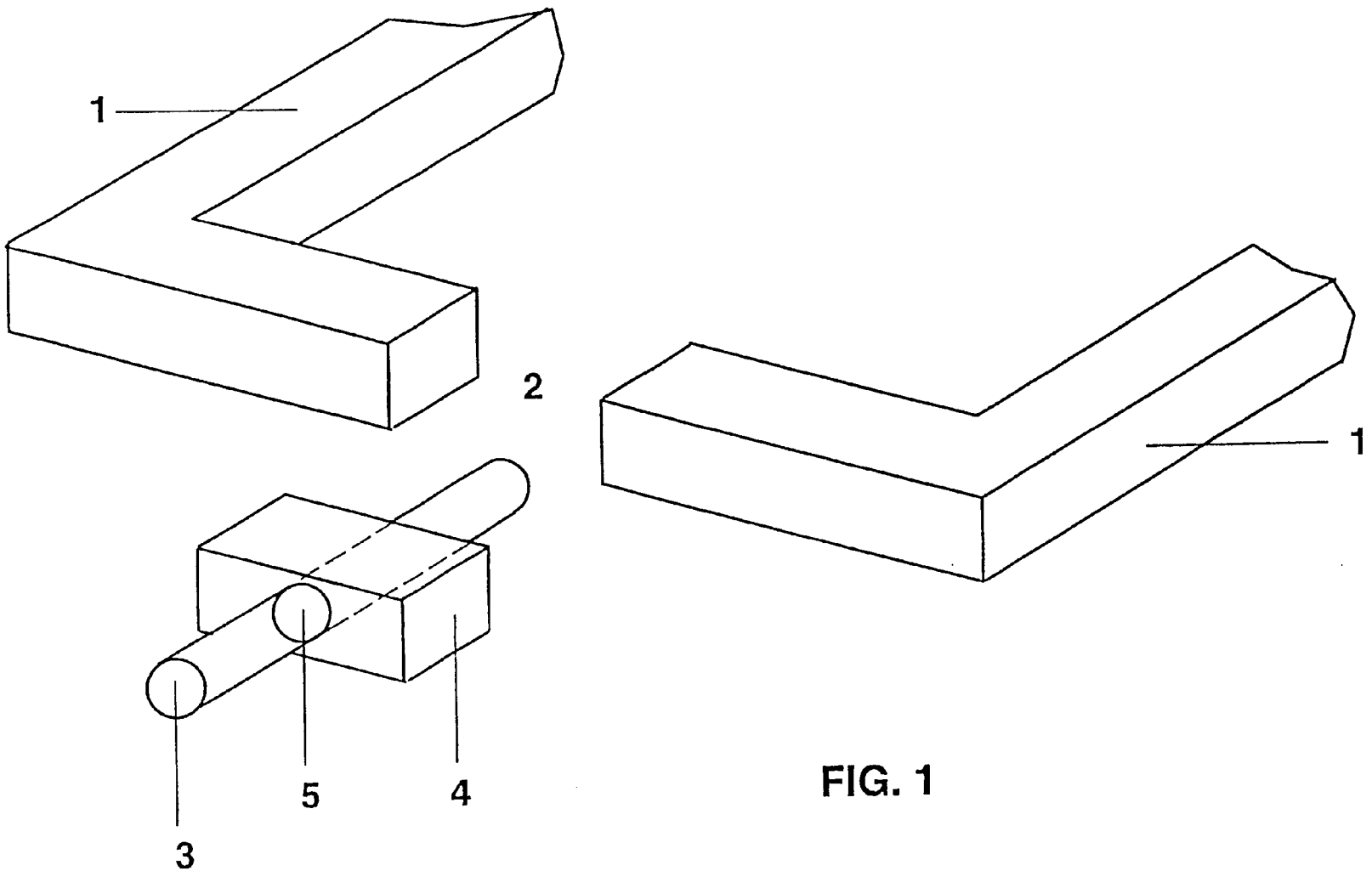
FIG. 1 shows an exhaust tube, provided with an adapter according to the invention, before insertion into an opening in a flat radiator frame.

FIG. 1 illustrates the method according to the invention schematically with a glass frame 1 of a silent flat radiator, which is not otherwise illustrated in more detail. Reference may be made once again to the application cited at the beginning in relation to the technology of silent flat radiators. The glass frame 1 has an opening 2 in the form of a hole, delimited by substantially plane lateral surfaces, in the glass strand forming a lateral edge of the frame 1. The interior of the discharge vessel, corresponds to the right-hand top side of the figure.

An exhaust tube 3 with a tubular basic shape is illustrated in the left-hand, lower region. An adapter 4 according to the invention is mounted on a front end of the exhaust tube 3 and consequently has a continuous opening 5 with an inner cross section corresponding to the exhaust tube 3. The outer dimensions of the adapter 4 correspond to a certain extent to the piece missing from the frame 1 in the opening 2. This means that the outer cross section (in the longitudinal direction of the exhaust tube, or in the direction of insertion) of the adapter 4 is matched to the shape and the dimensions of the opening 2, in this case to the rectangular cross-sectional shape of the missing piece of frame of 6.5 mm×6.5 mm in conjunction with a play of 0.2 mm, in each case.

Figure 2B:
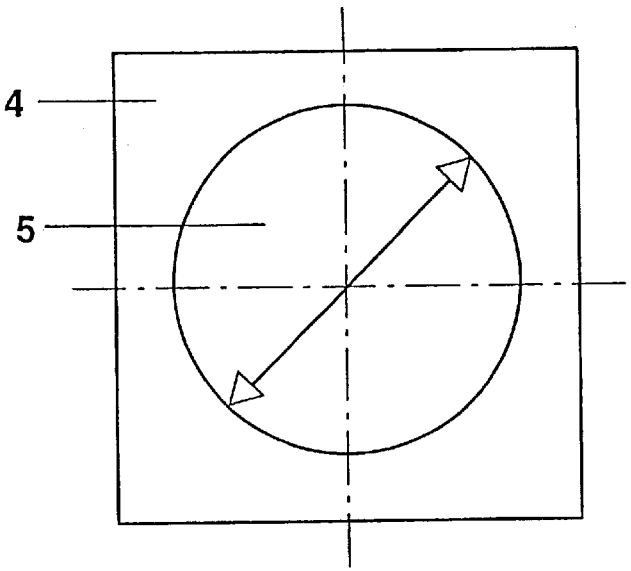
FIGS. 2*a* and 2*b* show a side view and a elevation of the adapter in FIG. 1.
Figure 2A:
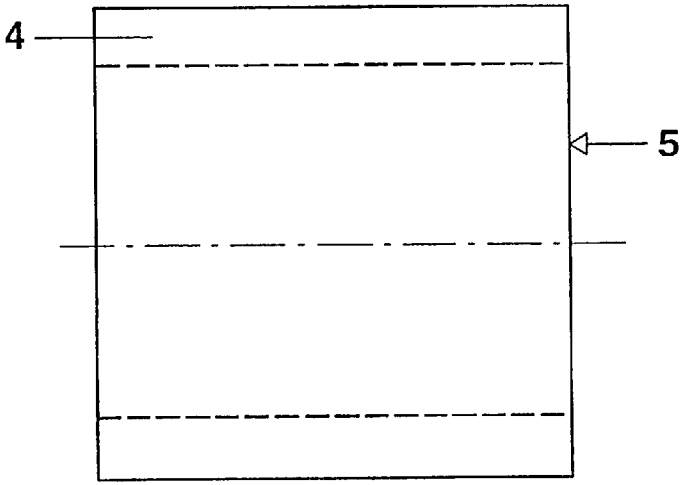

FIGS. 2*a* and 2*b* show the adapter 4 enlarged, a side view, seen transverse to the longitudinal direction of the exhaust tube 3, being illustrated in the left-hand half of FIG. 2*a*, and an illustration of the elevation, seen in the longitudinal direction of the exhaust tube 3, being illustrated in the right-hand half of FIG. 2*b*. In the left-hand side view, the continuous cylindrical opening 5 to be seen in cross section on the right-hand side is indicated by dashed lines. The opening 5 has an inner diameter of 5 mm, which is indicated by the double arrow and which corresponds to the outer diameter of the exhaust tube 3 in conjunction with a play of 0.1 mm.

Typical dimensions for the opening cross section 2 are generally in the region of a few mm per edge. It is to be borne in mind that the adapter 4 shrinks in the sintering step, and so it is necessary during strand extrusion to ensure a correspondingly greater dimension by comparison with the dimension of the opening 2 and of the exhaust tube 3.

Figure 3:
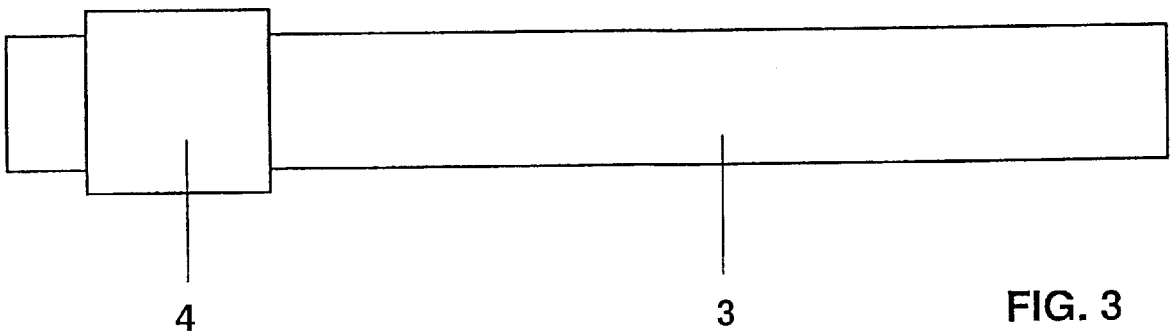
FIG. 3 shows a side view of the exhaust tube with a mounted adapter.

FIG. 3 shows the exhaust tube 3 in a lateral illustration, the adapter 4 in FIG. 2 being mounted on the front end on the left-hand side in FIG. 3.

The method proceeds as follows: a formable glass material is produced from pulverized lead borosilicate glass (glass solder) with the aid of a thermoplastic binder system. This glass material is extruded with dimensional accuracy at approximately 150° C. to form a strand which has a profile in accordance with FIG. 2*b*. Individual adapters 4 are cut to length from this strand with the aid of a diamond circular saw or a hot wire. The adapters 4 are plugged onto conventional round exhaust tubes 3. For this purpose, the inner diameter of the opening 5 in each adapter 4 has sufficient play (for example 0.1 mm) with reference to the outer diameter of the exhaust tube 3. The configuration in FIG. 3 is thereby achieved.

This is treated in a furnace at approximately 460° C., the binder firstly being volatilized, and the remaining glass powder being sintered. The adapter 4 is mounted firmly on the exhaust tube 3 in the process. The work steps so far can be carried out in large piece number separately from the actual lamp assembly. Each exhaust tube 3 provided with an adapter 4 is now inserted into a fitting opening 2 in the frame 1 of a flat radiator.

The opening 2 has been cut out of the frame by waterjet cutting before the assembly of the flat radiator housing. Thereafter, the plates of the flat radiator (which are not illustrated in FIG. 1) were loosely connected to the frame via a glass solder paste. the exhaust tube 3 with the adapter 4 is now inserted loosely into the opening 2. The entire structure is introduced into a furnace and treated at an increased temperature in a jointing step which is conventional per se. The plates are firmly connected to the frame 1 in the process; at the same time, the adapter 4 is fused in the opening 2 in a vacuum-tight fashion. In the case of this jointing step, the frame 1, the plates (not illustrated) and the exhaust tube 3 are not substantially softened. Only the glass solder between the frame 1 and plates, as well as the adapter 4 are fused. The viscosity of the. sintered glass solder of the adapter 4, which is relatively low during the jointing step, results in excellent, vacuum-tight fusing with the frame 1 and the exhaust tube 3. The further method, that is to say the evacuation of the lamp housing via the exhaust tube 3 and the following steps are conventional.

An alternative embodiment replaces the fusing of the adapter 4 during the jointing step in the furnace, and also the jointing step per se by irradiation with an infrared laser, which also produces a vacuum-tight connection between the frame 1 and the plates of the flat radiator. Reference may be made in this connection to the application already cited earlier. The designs there for assembling a lamp housing and for closing openings with the aid of laser irradiation in the case of infrared-absorbing glass materials are also valid by analogy for the adapter 4.

What is claimed is:

1. A method for producing a flat discharge vessel having a frame (1) connecting two housing plates, in which an exhaust tube (3) with a round outer cross section is tightly inserted into an opening (2) in the frame (1) with a square inner cross section, there being inserted between the exhaust tube (3) and the inner wall of the opening (2) a hard adapter (4) which has a continuous opening (5) adapted to the round outer cross section of the exhaust tube (3) and a square outer cross section adapted to the square inner cross section.

2. The method as claimed in claim 1, in which the adapter (4) has a lower softening temperature than the exhaust tube (3) and the inner wall, and is softened for the purpose of connecting the exhaust tube (3) to the inner wall, the exhaust tube (3) and the inner wall remaining substantially hard.

3. The method as claimed in claim 1, in which the adapter (4) is mounted on the exhaust tube (3) and connected to it before insertion into the opening.

4. The method as claimed in claim 1, in which the frame (1) consists of glass at the site of the opening (2), and the opening (2) is cut into the frame (1) by water jet.

5. The method as claimed in claim 1, in which the adapter (4) is injection molded.

6. The method as claimed in claim 1, in which the adapter (4) is pressed.

7. The method as claimed in claim 1, in which the adapter (4) is produced by extrusion and cutting the adapter (4) to length from an extruded strand.

8. The method as claimed in claim 1, in which the adapter (4) consists essentially of glass solder.

9. The method as claimed in claim 8, in which the glass solder contains a thermoplastic binder.

10. The method as claimed in claim 1, in which the exhaust tube (3) and the opening (2) are tightly connected by fusing on the adapter (4).

11. The method as claimed in claim 3, in which the adapter (4) is sintered onto the exhaust tube (3) and then fused on in the opening (2).

12. The method as claimed in claim 2, in which the adapter (4) is heated by laser irradiation.

13. The method as claimed in claim 2, in which the adapter (4) is heated in a furnace during an jointing step of the discharge vessel.

14. The method as claimed in claim 1, in which the discharge vessel is part of a gas discharge lamp.

15. The method as claimed in claim 14, in which the gas discharge lamp is designed for dielectrically impeded discharges.

* * * * *